United States Patent [19]

Roccaforte

[11] Patent Number: 5,014,855

[45] Date of Patent: May 14, 1991

[54] FLIP TOP SEALED CARTON WITH TEAR FILAMENT

[75] Inventor: Harry I. Roccaforte, Western Springs, Ill.

[73] Assignee: Waldorf Corporation, St. Paul, Minn.

[21] Appl. No.: 434,176

[22] Filed: Nov. 13, 1989

[51] Int. Cl.[5] ..... B65D 5/54

[52] U.S. Cl. ..... 206/616; 206/617; 229/905

[58] Field of Search ..... 229/145, 905; 206/611, 206/616, 617, 631.1

[56] References Cited

U.S. PATENT DOCUMENTS

| | | | |
|---|---|---|---|
| 754,201 | 3/1904 | Davalos . | |
| 2,909,312 | 10/1959 | Conerty | 206/611 |
| 2,981,455 | 4/1961 | Cope | 206/611 |
| 3,144,980 | 8/1964 | Larson | 206/611 |
| 3,426,936 | 2/1969 | Palmer . | |
| 3,447,733 | 6/1969 | Smith et al. | 206/616 |
| 3,599,859 | 8/1971 | Maierson | 206/611 |
| 3,640,449 | 2/1972 | Bastian | 206/617 |
| 3,758,023 | 9/1973 | Meyers | 206/611 |
| 4,621,736 | 11/1986 | Roccaforte | 206/616 |
| 4,669,614 | 6/1987 | Froom | 206/611 |
| 4,723,658 | 2/1988 | Steel | 206/616 |
| 4,773,542 | 9/1988 | Schillinger et al. | 229/905 |

OTHER PUBLICATIONS

Envelope shown in FIGS. 1-8 of Ser. No. 06/836,052 (abandoned).

*Primary Examiner*—Gary E. Elkins
*Attorney, Agent, or Firm*—Dorsey & Whitney

[57] ABSTRACT

A rectangular box carton according to the present invention has generally rectangular front, bottom, back, cover and closure panels. The front, bottom, back, cover and closure panels are consecutively joined at parallel fold lines. The closure panel is overlapped on and connected to the front panel to form a tube of generally rectangular cross section. Left and right endwall flap structures close the ends of the tube. Each endwall flap structure has a hood flap attached to said cover panel and adapted to form with the cover and closure panels a hinged, hooded lid that is opened by breaking the connection between the closure panel and front panel. Thereafter the lid is hinged to open and close to give access to contents of the carton. A tear filament is affixed to and across the inner surface of the closure panel to aid in severing the closure panel from the front panel.

26 Claims, 3 Drawing Sheets

FLIP TOP SEALED CARTON WITH TEAR FILAMENT

BACKGROUND OF THE INVENTION

1. Field of the Invention

The present invention relates generally to rectangular box cartons that open by lifting a hinged top or cover panel and a blank for forming such a carton. More particularly, the present invention relates to a "flip-top" rectangular box carton in which the cover panel is connected to a closure panel that seals the carton. The cover panel also has endwall insertion panels that may be inserted in the endwalls but are not glued in position.

2. Description of the Prior Art

Cartons for ice creams and other frozen desserts generally are made in half-gallon sizes and in one of two shapes: round boxes or rectangular boxes. In the rectangular box shape, the carton usually comes in one of two styles. First, it may be formed from an unglued blank shaped on a mandrel, then glued at its four corners. The resulting open-top box is filled through the wide opening at the top, then the hood or cover is sealed around the upper perimeter of the box. This forms a large "flip top" opening for the customer, a carton configuration referred to as the "Kliklok" style structure, named for the machinery used to form and close the carton. Second, rectangular box cartons may be preglued along a glue flap at one long edge, then filled from a small end opening. In this case, the glue flap (along one of the long edges) of the carton acts as the opener or one of the end flaps is lifted to open the carton. The end flaps are usually locked (but not sealed) by interlocking flap notches. While opening the carton at the glue flap gives a large "flip top" type opening, this opening cannot be easily reclosed. An opening at the locked end flaps provides reclosing capability, but the smaller opening is less convenient for dipping. Accordingly, the "flip-top" type opening is usually preferred, particularly when the hinged cover panel has, after opening, associated panels folded downward at ninety degrees around its free edges to help hold the cover panel down after reclosing.

The conventional equipment that locks the ends of rectangular cartons is fairly simple and has been in existence for many years (e.g., Anderson Model No. 555, made by APV Anderson Brothers Inc., 1303 Samuelson Road, Rockford, Ill. 61109). Many dairies have more than one such item of equipment in their plants. Recently, an inexpensive attachment that seals carton ends (primarily for tamper evidence) instead of locking them has also become available, but no adapter yet exists that permits the older equipment, augmented by the end sealer, to make a reclosable flip top or hooded carton of the first style discussed above. New equipment that can both form flip top cartons and also seal the ends is available but costly; it currently requires completely replacing the older equipment that is in the dairy and therefore involves a considerable investment. Often dairies are not in a position to replace their efficient, simple machines with the more expensive, complex ones, strictly to have carton ends glued and to provide a flip top or hooded opening for dispensing the ice cream or other product.

U.S. Pat. No. 4,773,542 shows a carton design that has a reclosable flip top and can be processed on conventional packaging equipment augmented by a sealing attachment. The present design is intended to improve on the design of U.S. Pat. No. 4,773,542 by providing a more efficient opening structure and additional sealing of the ends.

Most flip top or hooded rectangular box ice cream cartons have one of two types of opening devices:

(a) an outside glue flap glued to the front panel that is lifted and separated from the front panel upon opening; or (b) an outside glue flap formed with cuts for a tear strip and glued to the front panel so that removal of the tear strip severs the outside glue flap.

In an opening device of the first type, the glue flap often does not separate at the proper location or it delaminates, forming a web that can block access to the carton contents. A tear strip, on the other hand, often breaks before complete tearing across the glue flap. The opening failures are all too frequent with ice-cream cartons, because of the high moisture and low temperature conditions to which the cartons are necessarily subjected. In addition, the tear strip cuts weaken the glue flap during handling of the empty carton for filling, sometimes causing the carton to bend at these cuts rather than the bend score connection to the top panel. This bending causes machine jams during filling operations.

Accordingly, what is needed to improve the prior art is a carton design processable on conventional packaging equipment with end flaps and glue flaps configured for the standard folding sequence and with a simple, reliable opening device to allow the customer to easily open the carton and to dispense ice cream through a flip-top closure. In addition, it is desirable to be able to seal the ends of any such new carton by utilizing an economical sealing attachment with the conventional end-locking rectangular carton packaging equipment. Such equipment characteristically folds end flaps in the following order: bottom, top, back, front (carton viewed in normal position for flipping top open).

SUMMARY OF THE INVENTION

A rectangular box carton according to the present invention comprises generally rectangular front, bottom, back, cover and closure panels, said front, bottom, back, cover and closure panels being consecutively joined at parallel fold lines. The closure panel is overlapped on and connected to said front panel to form a tube of generally rectangular cross section. Left and right endwall means close the ends of the tube. Each endwall means comprises a hood flap attached to said cover panel and adapted to form with the cover and closure panels a hinged, hooded lid that is opened by breaking the connection between the closure panel and front panel. Thereafter, the hooded lid may be opened and closed to give access to contents of the carton. A tear filament is affixed to and across the inner surface of said closure panel substantially parallel to but spaced from the fold line between said front panel and closure panel. The closure panel is severed by the tear filament affixed to its interior during opening of the carton.

It is an objective of the present invention to provide a flip top or hooded rectangular box carton with tamper-evident sealing that is closed with the same flap folding sequence as used by conventional end-locking equipment, thereby retaining the same filling method and ability to process cartons at essentially the same speed.

It is another objective of the invention to provide a flip top rectangular box carton that can be easily and reliably opened and reclosed by the end user, without tear strip cuts that unduly weaken the closure flap.

It is a further objective of the present invention to provide a carton design that permits a flip-top rectangular carton with sealed ends to be processed on conventional end-locking equipment augmented with an inexpensive end-seal adapter.

These and other objectives of the invention will become clearer in the following detailed discussion of the preferred embodiment of the invention, including the following drawings.

DESCRIPTION OF THE PREFERRED EMBODIMENTS

Figure 1:
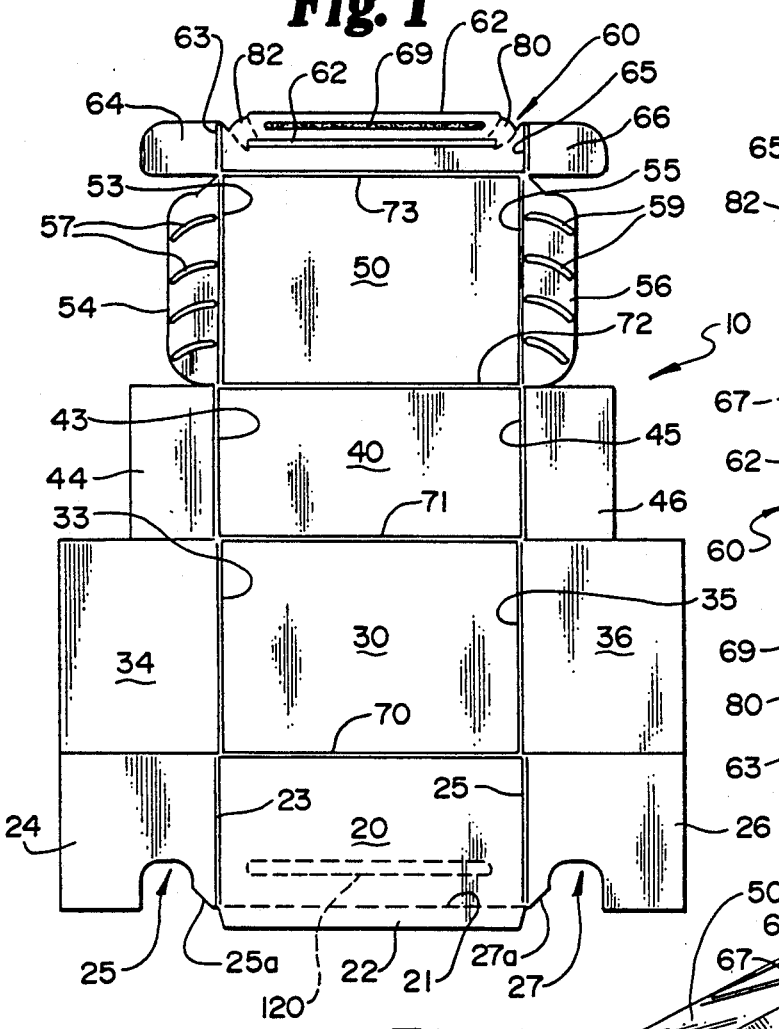
FIG. 1 is a plan view of a flat carton blank in accordance with the invention before it is assembled.

As seen in FIG. 1, the carton is made from a flat blank 10 consisting of several panels joined consecutively at four parallel fold lines. In particular, the carton blank 10 in its preferred embodiment consists of a front panel 20, a bottom panel 30, a back panel 40, a cover panel 50 and closure panel 60, each with its own auxiliary flaps and features to be described.

Turning first to the front panel 20, it consists of a generally rectangular panel 20 attached at a first major fold line 70 to bottom panel 30. Opposite and parallel to the fold line 70 is a narrow selvage flap 22 (optional, but present in the preferred embodiment to aid in preventing sifting of product) separated from the main portion of the front panel 20 at a perforated line 21 parallel to fold line 70. At opposing parallel side fold lines 23, 25 of the front panel 20 symmetrical, generally rectangular, right and left front endwall flaps 24, 26, respectively, are attached. Both front endwall flaps 24, 26 include a generally U-shaped notch 25, 27, respectively, that incorporates an angle cut **25*a*, 27*a*, respectively. Adhesives are applied to the front panel 20 and to the front endwall flaps 24, 26 during assembly and filling of the blank 10**, as will be explained later.

One side of the generally rectangular bottom panel 30 is attached to the front panel 20 at a first major fold line 70. At an opposing, parallel, second major fold line 71 the bottom panel 30 is also attached to the back panel 40. At opposing parallel side fold lines 33, 35, symmetrical, generally rectangular, left and right bottom endwall flaps 34, 36, respectively, are attached to the bottom panel 30.

One side of the generally rectangular back panel 40 is attached to bottom panel 30 at the second major fold line 71. Back panel 40 is also attached to the cover panel 50 at an opposing, parallel, third major fold line 72. At opposing, parallel side fold lines 43, 45, symmetrical, left and right back endwall flaps or bolsters 44, 46, respectively, are attached to back panel 40. Each such back endwall flap 44, 46 is generally rectangular, but smaller in size than the bottom endwall flaps 34, 36.

The cover panel 50 is generally rectangular and is attached both to the back panel 40 at a third major fold line 72 and to the closure panel 60 at the fourth major fold line 73 parallel to fold line 72. At opposing parallel side fold lines 53, 55 of the cover panel 50, symmetrical, left and right cover endwall insertion flaps (or hood flaps) 54, 56, respectively, are attached to the cover panel 50. The left cover endwall insertion flap 54 includes a series of radial embossments 57. The right cover endwall insertion flap 56 includes a similar set of radial embossments 59.

Figure 9:
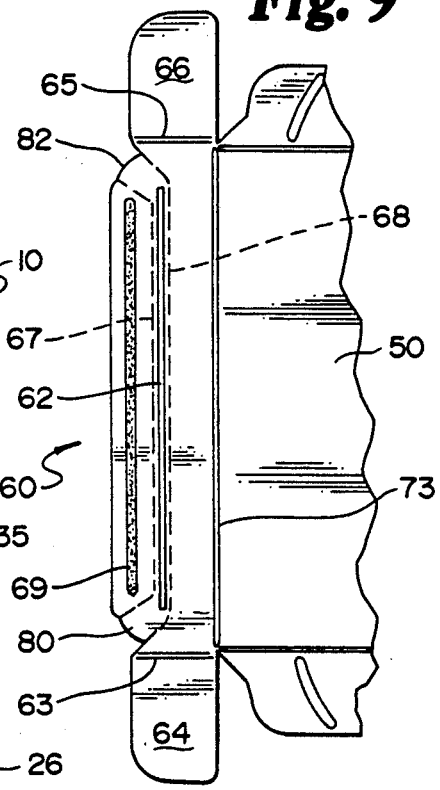
FIG. 9 is a plan view of the inner side of the closure panel of the present invention showing the tear filament and associated cuts.

The closure panel 60 is attached to the cover panel 50 at the fourth major fold line 73 and has a free edge opposite the fold line 73. It also includes at opposing parallel fold lines 63, 65 symmetrical right and left closure endwall flaps 64, 66, respectively. In addition, the closure panel 60 incorporates a tear filament 62 with opposed ends and opposed longitudinal edges between the ends. The tear filament 62 extends between a pair of tear tabs 80, 82 defined by short, converging through-cuts extending from the outer or free edge of the closure panel 60 toward the ends of the tear filament 62. As an option, these through cuts can be extended by a pair of partial (30% to 50%) cuts 67, 68 (see FIGS. 7, 8) into the exterior surface of the closure panel 60 that extend parallel to and almost coincident with the longitudinal edges of the tear filament 62. As best seen in FIG. 9, the tear tabs 80, 82 form obtuse angles with the tear filament 62 and its longitudinal edges. The angle formed is approximately 135 degrees. A portion of each tear tab 80, 82 extends to or below the glue area 69, so that the tear tabs 80, 82 span the ends of the glue area 69 in extending from the free edge of the closure panel 60 to the tear filament 62.

The tear filament 62 is preferably a high tensile tape of polypropylene or other similar plastic (with or without reinforcing fibers) with a thickness of about 100 microns (4.0 mils) and a tensile strength of about 400 Newtons/25 mm (91 lbs./in.). It is affixed to the interior surface of the closure panel 60 by a pre-applied adhesive or it may be impregnated with hot melt glue and hot-rolled onto the closure panel 60. String or other filament material that is relatively thin but of suitable strength could also be used and similarly adhered.

As noted above and shown in FIGS. 7, 8, the closure panel 60 includes a glue area 69 that extends between the tear tabs 80, 82 parallel to the tear filament 62. The adhesive connection between the closure panel 60 and the front panel 20 occurs in this area. The tear tabs 80, 82 and the tear filament 62 effectively define a tear filament flap as part of the closure panel 60 along its free or outer edge. This tear filament flap forms a connection between the front panel 20 and the closure panel 60 until the closure panel 60 is severed by the tear filament 62 at the opening of the carton. Until the tear filament 62 is used for opening, it is desired that the closure panel 60 remain rigid so that the panels 20, 30, 40, 50 and 60 can be folded, glued and erected to form a tube with a solid rectangular cross-section. For this reason, the cuts 67, 68 are shallow, so as not to promote bending of the closure panel 60 near the filament 62.

The carton blank 10 will normally be sealed (by the carton manufacturer) to form a collapsed tube by application of adhesive 120 to the outside of front panel 120, prior to folding at major fold lines 70, and 72 to form the collapsed tube. The tear filament 62 will be affixed at the same stage of manufacture. The tube form of the blank 10 is then shipped flat for assembly and filling to a dairy or other frozen dessert manufacturer.

Figure 2:
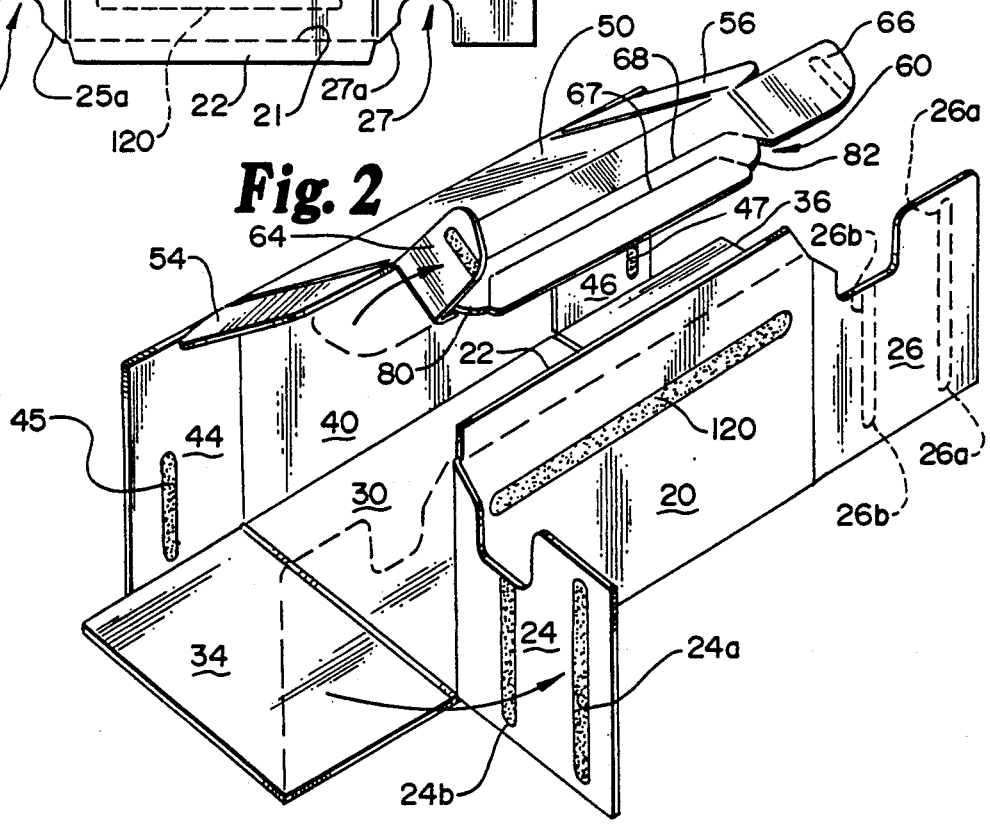
FIG. 2 is a perspective view of the carton blank bent in preparation for sealing of the manufacturer's joint.
Figure 6:
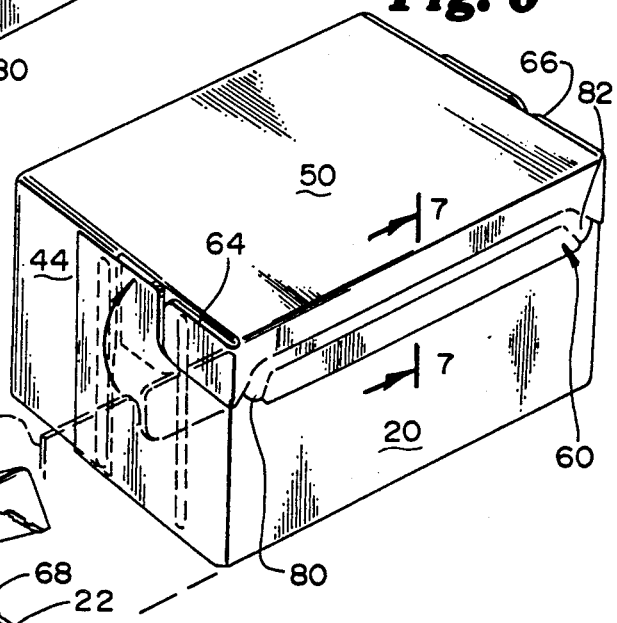
FIG. 6 is a perspective view of the carton at the fifth step of assembly of the endwalls.
Figure 7:
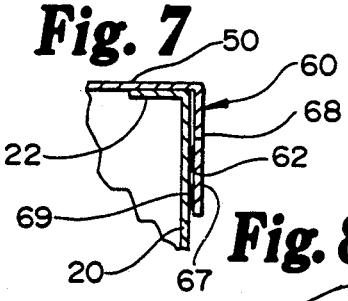
FIG. 7 is a partial sectional elevation taken along line 7—7 of FIG. 6.
Figure 8:
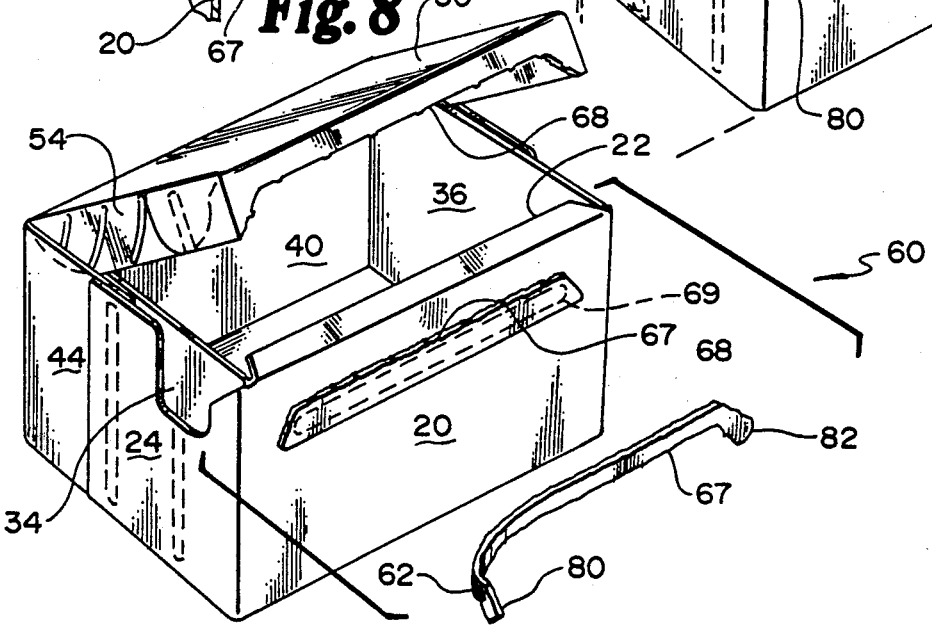
FIG. 8 is a perspective view of a completed and sealed carton being opened.

As best seen in FIGS. 2–8, assembly of the flat blank 10 into a carton occurs by first forming a tube of rectangular cross section by erecting the front, bottom, back, cover and closure panels, 20, 30, 40, 50 and 60, respectively, at right angle folds at the first through fourth major fold lines 70–73. The carton is held in its tubular configuration by the contact adhesive 120 applied along the outside of the front panel 20. The contact adhesive 120 is positioned on the front panel 20 such that it contacts the closure flap 60 at glue area 69 between its outer or free edge and the tear filament 62 (FIGS. 2, 7).

Figure 3:
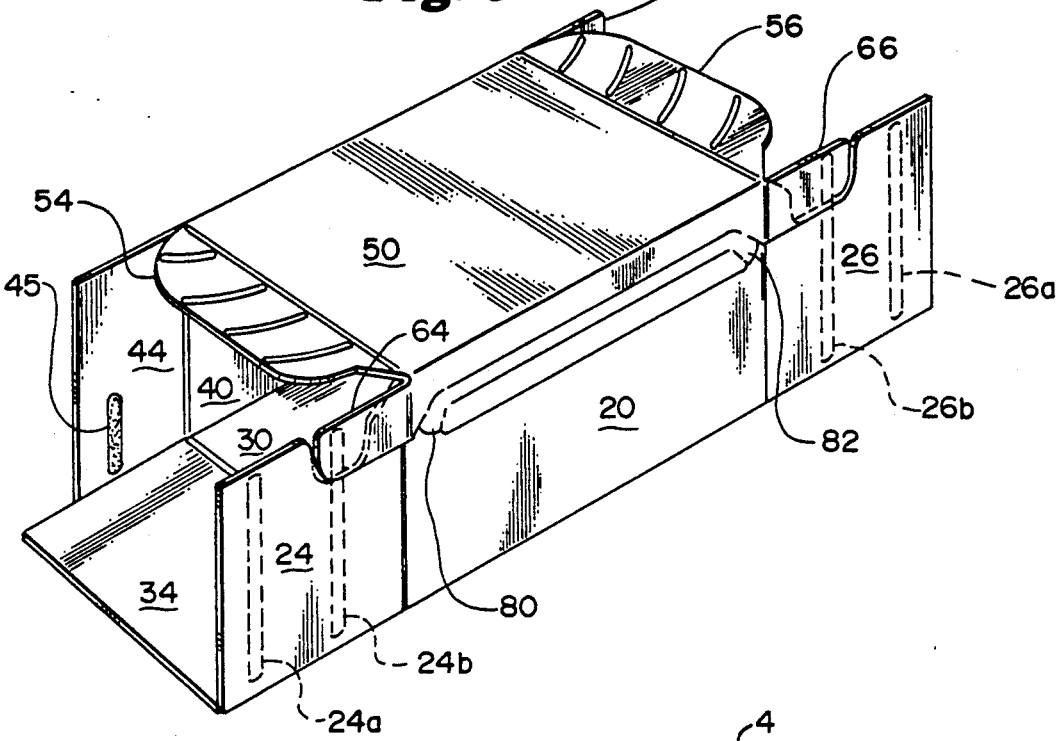
FIG. 3 is a perspective view of the carton at the first step of assembly of the endwalls.
Figure 4:
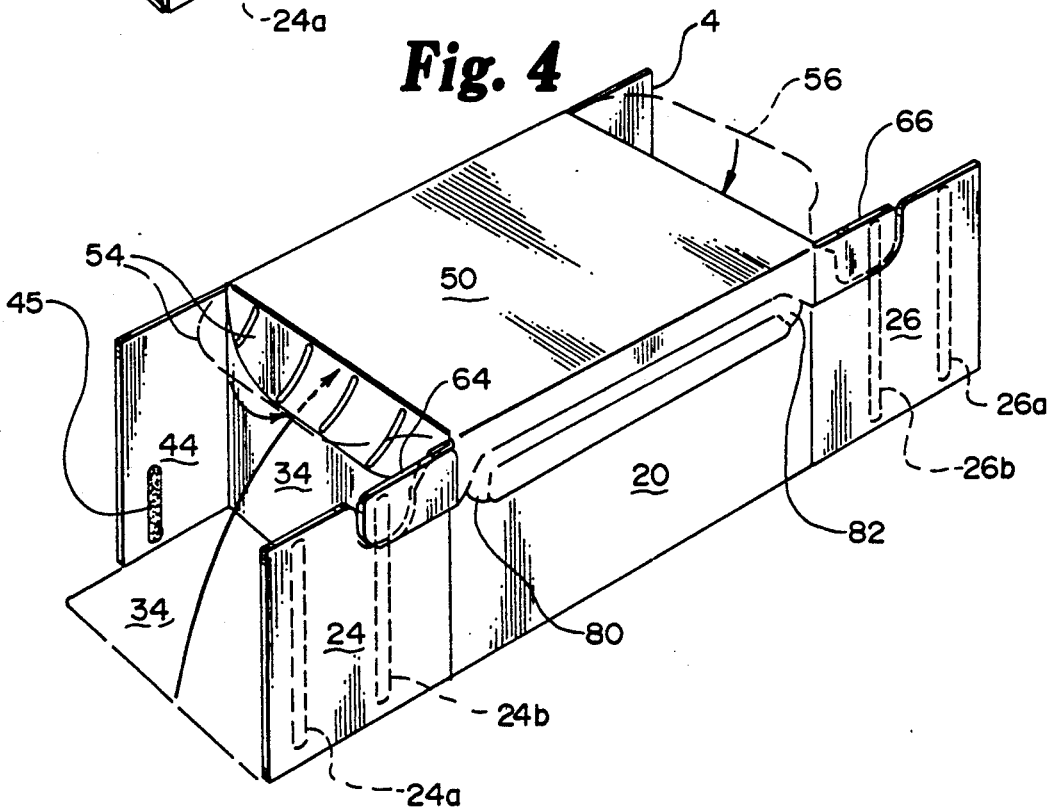
FIG. 4 is a perspective view of the carton at the second and third steps of assembly of the endwalls.
Figure 5:
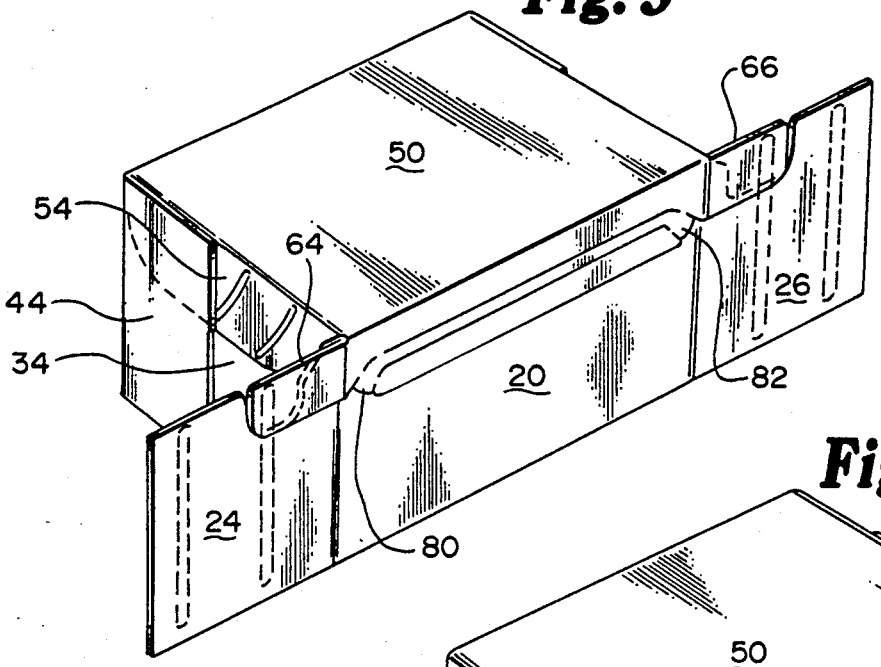
FIG. 5 is a perspective view of the carton at the fourth step of assembly of the endwalls.

When the blank 10 has been erected (at the dairy) into the tubular configuration shown in FIG. 3, the closure endwall flaps 64, 66 overlap a portion of the front panel endwall flaps 24, 26, in particular, the area of U-shaped notches 25, 27. When the partially assembled carton is in this configuration, assembly of the right and left endwall means of the carton can proceed.

The folding sequence for the various endwall flaps when forming the endwall means of the cartons is as follows. Because the left and right endwall means are handled symmetrically, the sequence will be explained only with respect to the left endwall flaps, shown at the left side of FIG. 4. First, the bottom endwall flap 34 is folded upward at a 90 degree angle. In this position, the bottom endwall flap 34 substantially covers the entire tubular cross section. Second, the cover endwall insertion flap (or hood flap) 54 is folded downward at a 90 degree angle to overlap the upper portion of the bottom endwall flap 34. Third, referring now to FIG. 5, the left rear endwall flap 44 is folded at a 90 degree angle so that it overlies the bottom and cover endwall flaps 34 and 54. To secure the rear endwall flap 44 to bottom and cover endwall flaps 34, 54 and provide additional potential tamper evidence, an adhesive strip 45 may be applied to the lower portion of the rear endwall flap 44. Note that the adhesive strip 45 extends across the rear endwall flap 44 only as far as the lower edge of the cover endwall insertion flap 54. Adhesive is next applied to the overlapping flaps 24 and 64 in two linear strips. The outer adhesive strip **24*a* extends transversely across the front endwall flap 24 near the outer edge of such flap. The inner adhesive strip 24*b*, also applied to flap 24, is parallel to the corresponding first adhesive strip 24*a* but extends also onto the closure endwall flap 64 in the area of the U-shaped notch 25. With the adhesive strips 24*a*, 24*b*** in place, the left end can now be completed and sealed.

Referring now also to FIG. 6, the front endwall flap 24 and the corresponding closure endwall flap 64 are together folded at 90 degrees against the previously folded flaps 34, 54 and 44. At this point the adhesive strip **24*a* comes into contact with the rear endwall flap 44. The width of bottom endwall flap 44 keeps the adhesive strip 24*a* from contacting the cover endwall insertion flap 54. In addition, the adhesive strip 24*b* contacts the bottom endwall flap 34, except for that portion of the adhesive strip 24*b* placed on the closure endwall flap 64 in the U-shaped notch 25, which adheres to the cover endwall insertion flap 54 where this is exposed by the U-shaped notch 25**.

The carton with one end sealed can now be filled with ice cream or other frozen dessert through the unsealed end. A similar folding and glue application sequence is used for the right endwall flaps 26, 36, 46, 56 and 66, to form the right endwall means and to make the carton closed and sealed. Following purchase, the carton may be opened by a consumer by lifting and pulling on one of the tabs 80, 82 of the closure panel 60 (which have not been glued) and tearing upward, then across to follow the path of the tear filament. Once the tear filament 62 is fully torn across the closure panel 60, that panel is no longer connected to the front panel 20 and the cover panel 50 may be lifted, because the width of the back endwall flaps 44, 46 has prevented the adhesive in strips **24*a* and 26*a* from adhering to the cover endwall insertion flaps 54, 56. At the same time, the closure endwall flaps 64, 66 have formed corners for a flip top hood or cover by adhering to the cover endwall insertion flaps 54, 56. That is, the cover endwall insertion flaps 54, 56 have now assumed the role of hood flaps at opposed ends of a flip top hood hinged at fold line 72. The closure panel 60 forms the third wall of the flip top hood. Radial embossments 57, 59 aid in keeping the flip top hood or cover free to be lifted and reclosed. The tear filament 62 ensures a more reliable, cleaner tear across the closure panel 60 than tearing with a perforated tear strip. The angled position of tabs 80, 82 gives the user an easy grasp and method for starting the horizontal tear of the tear filament 62 from either end. Partial cuts 67, 68 adjacent the longitudinal edges of the tear filament 62 can facilitate tearing but should not be used if the cuts reduce the stiffness of the closure panel 60 so that bending occurs along the cuts 67, 68 rather than along the fold line 73**.

In conclusion, when used in a conventional packaging equipment assembly line, the flat blank 10 of the present invention (with manufacturer's joint preglued) is first formed into a rectangular tube. Then, one set of endwall flaps is folded in the conventional sequence, with an adapter on the conventional equipment being used to seal that end. The carton is then filled at the opposed end, and that end is sealed in a like manner. The completed and filled carton is shipped out for consumer purchase. Because access to the contents normally cannot be obtained without breaking or tearing one or more seals or flaps, in particular, the seal at closure flap 60, the purchaser can determine whether the carton seal is intact, thereby receiving an assurance that the carton has not been previously opened or tampered with. Gluing of the endwall panels can provide further deterrence to and evidence of possible tampering. In the present design gluing occurs between several layers of flaps forming the endwall means. The configuration of the endwall means and cover flaps provides a reclosable opening after the consumer breaks the closure flap seal.

It will be seen by those skilled in the art that various changes may be made in the preferred embodiments shown above without departing from the scope of the invention. The invention is therefore not limited to what is shown in the drawings and described in the specification but only as indicated in the appended claims.

What is claimed as new and desired to be secured by Letters Patent is:

1. A rectangular box carton comprising:

(a) a front panel, a bottom panel, a back panel, a cover panel and a closure panel, said front, bottom, back, cover and closure panels being generally rectangular and consecutively joined at right angles at parallel fold lines and said closure panel having a free edge opposite the fold line between said cover and closure panels, said closure panel further being overlapped on and connected to said front panel adjacent said free edge to form a tube of generally rectangular cross section;

(b) left and right endwall means for closing each end of said tube, each endwall means comprising a hood flap attached to said cover panel and adapted to form with the cover and closure panels a hinged, hooded lid that is opened by breaking the connection between the closure panel and front panel and that is thereafter hinged to open and close to give access to contents of the carton; and (c) a tear filament affixed to and across the inner surface of said closure panel substantially parallel to but spaced from the fold line between the cover and closure panels, said tear filament having opposed ends, opposed longitudinal edges between the ends and at least one tear tab associated with one of said ends of said tear filament, said at least one tear tab associated with the tear filament extending from the free edge of said closure panel toward one of said ends of said tear filament and comprising a pair of cuts in the closure panel, each said cut leading toward one of said ends of said tear filament.

2. The carton as recited in claim 1 wherein said at least one tear tab forms an obtus angle with one of the longitudinal edges of the tear filament.

3. The carton as recited in claim 2 wherein the obtuse angle is approximately 135 degrees.

4. The carton as recited in claim 1 wherein the closure panel is connected to the front panel by adhesive material located in an area between the free edge of the cover panel and the tear filament.

5. The carton as recited in claim 1 further comprising a selvage flap connected to said front panel along a fold line substantially coincident with the fold line between the cover and closure panels.

6. A rectangular box carton comprising:

(a) a front panel, a bottom panel, a back panel, a cover panel and a closure panel, said front, bottom, back, cover and closure panels being generally rectangular and consecutively joined at right angles at parallel fold lines and said closure panel having a free edge opposite the fold line between said cover and closure panels, said closure panel further being overlapped on and connected to said front panel adjacent said free edge to form a tube of generally rectangular cross section;

(b) left and right endwall means for closing each end of said tube, each endwall means comprising a hood flap attached to said cover panel and adapted to form with the cover and closure panels a hinged, hooded lid that is opened by breaking the connection between the closure panel and front panel and that is thereafter hinged to open and close to give access to contents of the carton; and (c) a tear filament affixed to and across the inner surface of said closure panel substantially parallel to but spaced from the fold line between the cover and closure panels, said tear filament having associated therewith partial cuts through the closure panel that run along either longitudinal edge of said tear filament.

7. A rectangular box carton comprising:

(a) a front panel, a bottom panel, a back panel, a cover panel and a closure panel, said front, bottom, back, cover and closure panels being generally rectangular and consecutively joined at right angles at parallel fold lines and said closure panel having a free edge opposite the fold line between said cover and closure panels, said closure panel further being overlapped on and connected to said front panel adjacent said free edge to form a tube of generally rectangular cross section;

(b) left and right endwall means for closing each end of said tube, each endwall means comprising a hood flap attached to said cover panel and adapted to form with the cover and closure panels a hinged, hooded lid that is opened by breaking the connection between the closure panel and front panel and that is thereafter hinged to open and close to give access to contents of the carton, each of the left and right endwall means comprising:

a first endwall flap attached to said bottom panel and covering substantially the entire tube cross section to form an innermost layer of each endwall means, with said hood flap lying adjacent said first endwall flap and serving as a second endwall flap that overlaps only an upper portion of the first endwall flap;

a third endwall flap attached to said back panel and overlying a portion of said first and second endwall flaps, said third endwall flap overlying only a rear portion of said first and second endwall flaps;

a fourth endwall flap attached to said front panel and overlapping a portion of said first, second and third endwall flaps, said fourth endwall flap having a connection notch therein near an end of the fold line at which the cover and closure panels are joined, said connection notch exposing a corner of said second endwall flap nearest the closure panel;

a fifth endwall flap attached to said closure panel, said fifth endwall flap overlying at least a portion of that corner of the second endwall flap that is exposed by the connection notch;

a first adhesive strip applied to said fourth endwall flap substantially parallel to the fold line at which said fourth endwall flap is attached to the front panel, said first adhesive strip affixing said fourth endwall flap to the third endwall flap but not to the second endwall flap; and a second adhesive strip applied to said fourth endwall flap and the fifth endwall flap substantially parallel to the fold line at which said fourth endwall flap is attached to the front panel, said second adhesive strip connecting said fourth endwall flap to the first endwall flap and said fifth endwall flap to the second endwall flap; and (c) a tear filament affixed to and across the inner surface of said closure panel substantially parallel to but spaced from the fold line between the cover and closure panels.

8. The rectangular box carton recited in claim 7 wherein each second endwall flap has one or more radial embossments thereon.

9. The rectangular box carton recited in claim 7 wherein the third endwall flap has an adhesive strip that affixes the third endwall flap to the first endwall flap but not to the second endwall flap.

10. A blank for forming a rectangular box carton comprising:

(a) a generally rectangular front panel having a first pair of endwall flaps attached thereto at parallel, opposed sides of said front panel, each said endwall flap having a connection notch therein;

(b) a generally rectangular bottom panel connected to said front panel at a first major fold line, said bottom panel having a second pair of endwall flaps attached thereto at parallel, opposed sides of said bottom panel;

(c) a generally rectangular back panel connected to said bottom panel at a second major fold line parallel to said first major fold line, said back panel having a third pair of endwall flaps attached thereto at parallel opposed sides of said back panel;

(d) a generally rectangular cover panel connected to said back panel at a third major fold line parallel to said first major fold line, said cover panel having a pair of endwall insertion flaps attached thereto at parallel opposed sides of said cover panel;

(e) a generally rectangular closure panel connected to said cover panel at a fourth major fold line parallel to said first major fold line, said closure panel having a free edge opposite said fourth major fold line and having a pair of corner flaps attached thereto at parallel, opposed edges of said closure panel, each said corner flap being adapted to align with at least a portion of the connection notch of one said endwall flap of said front panel and to contact an underlying panel through said connection notch, when the front, bottom, back, cover and closure panels and the endwall flaps of the front, bottom and back panels and the endwall insertion flap of the cover panel are folded together to form a generally rectangular box carton with endwall means for closing the carton formed from overlying endwall flaps; and (f) a tear filament affixed to and across the inner surface of the closure panel substantially parallel to said fourth major fold line but being spaced therefrom and also spaced from the free edge of said closure panel.

11. The blank as recited in claim 10 wherein the tear filament has opposed ends, opposed longitudinal edges between the ends and at least one tear tab associated with one of said ends of said tear filament, said one tear tab comprising a pair of cuts in the closure panel, each said cut leading toward one of said ends of said tear filament.

12. The blank as recited in claim 11 wherein each endwall insertion flap has one or more radial embossments thereon.

13. The blank as recited in claim 10 wherein the closure panel is connected to the front panel by adhesive material located in an area between the free edge of the cover panel and the tear filament.

14. The blank as recited in claim 10 wherein the tear filament has associated therewith partial cuts through the closure panel that run along either longitudinal edge of said tear filament.

15. The blank as recited in claim 10 further comprising a selvage flap connected to said front panel along a fold line parallel to said first major fold line.

16. The blank as recited in claim 11 wherein said at least one tear tab associated with the tear filament extends from the free edge of said closure panel toward one of said ends of said tear filament.

17. The blank as recited in claim 16 wherein said at least one tear tab forms an obtuse angle with one of the longitudinal edges of the tear filament.

18. The blank as recited in claim 17 wherein the obtuse angle is approximately 135 degrees.

19. A rectangular box carton comprising:

(a) a front panel, a bottom panel, a back panel, a cover panel and a closure panel, said front, bottom, back, cover and closure panels being generally rectangular and consecutively joined at right angles at parallel fold lines and said closure panel having a free edge opposite the fold line between said cover and closure panels and being overlapped on and connected to said front panel adjacent said free edge to form a tube of generally rectangular cross section;

(b) left and right endwall means for closing each end of said tube, each endwall means comprising:

(i) a first endwall flap attached to said bottom panel and covering substantially the entire tube cross section to form an innermost layer of each endwall means;

(ii) second endwall flap attached to said cover panel and lying adjacent said first endwall flap, said second flap overlapping only an upper portion of the first endwall flap;

(iii) a third endwall flap attached to said back panel and overlying a portion of said first and second endwall flaps, said third endwall flap overlying only a rear portion of said first and second endwall flaps;

(iv) a fourth endwall flap attached to said front panel and overlapping a portion of said first, second and third endwall flaps, said fourth endwall flap having a connection notch therein near an end of the fold line at which the cover and closure panels are joined, said connection notch exposing a corner of said second endwall flap nearest the closure panel; and (v) a fifth endwall flap attached to said closure panel, said fifth endwall flap overlying at least a portion of that corner of the second endwall flap that is exposed by the connection notch;

(c) a first adhesive strip applied to said fourth endwall flap substantially parallel to the foldline at which said fourth endwall flap is attached to the front panel, said first adhesive strip affixing said fourth endwall flap to the third endwall flap but not to the second endwall flap;

(d) a second adhesive strip applied to said fourth endwall flap and the fifth endwall flap substantially parallel to the foldline at which said fourth endwall flap is attached to the front panel, said second adhesive strip connecting said fourth endwall flap to the first endwall flap and said fifth endwall flap to the second endwall flap; and (e) a tear filament affixed to and across the inner surface of said closure panel substantially parallel to said fourth major fold line but being spaced therefrom and from the connection of said closure panel to said front panel adjacent the free edge of said closure panel.

20. The carton recited in claim 19 wherein the tear filament has opposed ends, opposed longitudinal edges between the ends and at least one tear tab associated with one of said ends of said tear filament, said one tear tab comprising a pair of cuts in the closure panel, each said cut leading toward one of said ends of said tear filament.

21. The carton recited in claim 20 wherein each second endwall flap has one or more radial embossments thereon.

22. The carton recited in claim 20 wherein said at least one tear tab associated with the tear filament extends from the free edge of said closure panel toward one of said ends of said tear filament.

23. The carton as recited in claim 19 wherein the closure panel is connected to the front panel by adhesive material located in an area between the free edge of the cover panel and the tear filament.

24. The carton as recited in claim 19 wherein the tear filament has associated therewith partial cuts through the closure panel that run along either longitudinal edge of said tear filament.

25. The carton as recited in claim 19 further comprising a selvage flap connected to said front panel along a fold line parallel to said first major fold line.

26. The carton as recited in claim 19 further comprising a third adhesive strip applied to said third endwall flap, said third adhesive strip connecting said third endwall flap to said first endwall flap but not to said second endwall flap.

* * * * *